US008210530B1

(12) United States Patent
Gayne et al.

(10) Patent No.: US 8,210,530 B1
(45) Date of Patent: Jul. 3, 2012

(54) CLUTCHED NIP SEPARATOR DEVICE FOR A ROLL ASSEMBLY

(75) Inventors: Jarrett Clark Gayne, Lexington, KY (US); Michael Alan Gist, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 13/074,909

(22) Filed: Mar. 29, 2011

(51) Int. Cl.
*B65H 5/02* (2006.01)

(52) U.S. Cl. ..... 271/273; 271/274

(58) Field of Classification Search ..... 271/273, 271/274

See application file for complete search history.

(56) References Cited

U.S. PATENT DOCUMENTS

| | | | | |
|---|---|---|---|---|
| 5,666,608 | A | 9/1997 | Christensen | |
| 6,817,611 | B2 * | 11/2004 | DiRamio | 271/273 |
| 7,448,624 | B2 * | 11/2008 | Lee | 271/274 |
| 7,455,295 | B2 * | 11/2008 | Marx et al. | 271/273 |
| 7,621,528 | B2 * | 11/2009 | Hara | 271/274 |
| 2006/0071419 | A1 * | 4/2006 | Lee | 271/272 |
| 2007/0138732 | A1 | 6/2007 | Hackney | |
| 2007/0228647 | A1 * | 10/2007 | Hara | 271/272 |
| 2011/0044722 | A1 | 2/2011 | Agnissey | |

* cited by examiner

*Primary Examiner* — David H Bollinger
(74) *Attorney, Agent, or Firm* — John Victor Pezdek

(57) ABSTRACT

A roll assembly, including a frame; a first component mounted to the frame and having a shaft, the shaft; a second component rotatably mounted to the frame and disposed in proximity with the first component, wherein at least one of the first component and the second component is translatable relative to the other; and at least two separator devices mounted on ends of the shaft of one of the first and second component when in a first rotational position separate the first component and second component. Each separator device includes an aperture for mounting on a clutch that is mounted on the shaft of the first component and rotation of the second component in the first direction disengages the separation devices allowing the first and second components to touch and the separation devices to move to a second rotational position and rotation of the shaft in the first direction engages the clutch to rotate the separation devices back to the first rotational position.

12 Claims, 11 Drawing Sheets

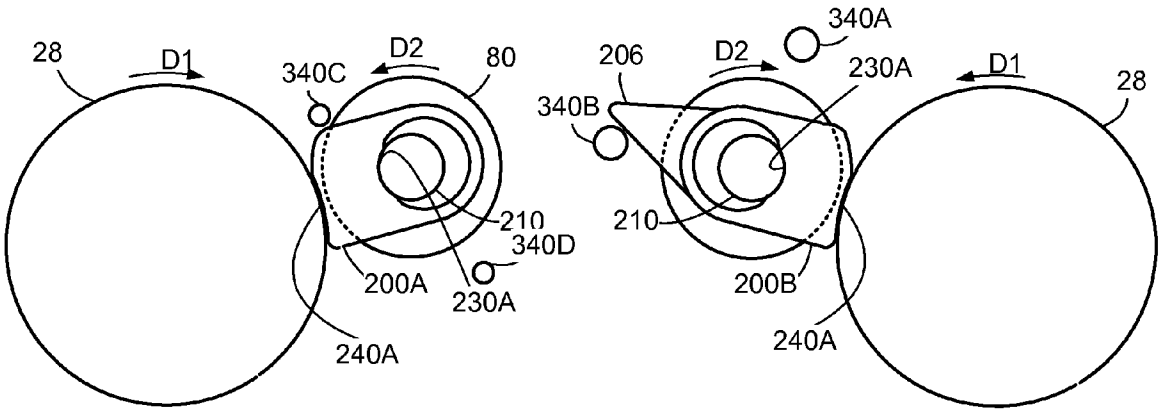
FIG. 5B
FIG. 5A
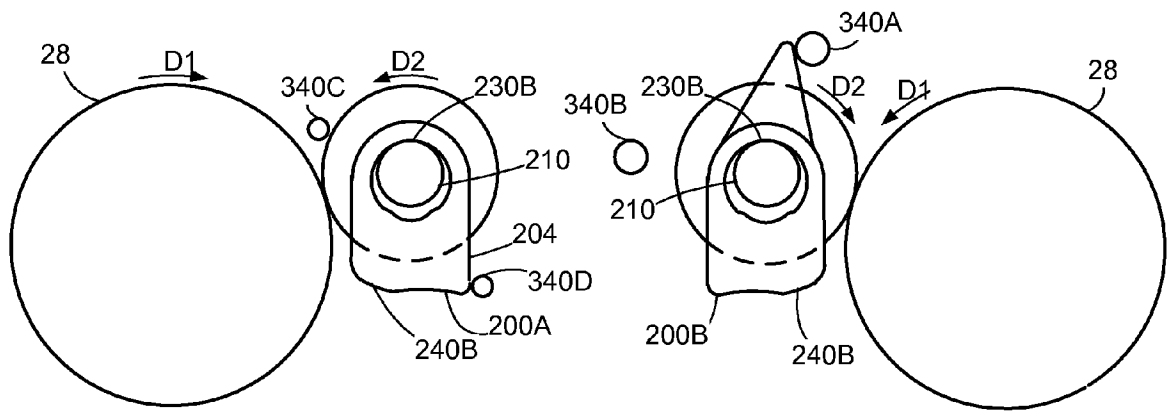
FIG. 6B
FIG. 6A

CLUTCHED NIP SEPARATOR DEVICE FOR A ROLL ASSEMBLY

CROSS REFERENCES TO RELATED APPLICATIONS

This patent application is related to the U.S. patent application Ser. No. 13/074,882, filed Mar. 29, 2011, entitled "Nip Separator Device For A Roll Assembly" and assigned to the assignee of the present application.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Disclosure

This disclosure relates generally to printers and, specifically, to devices for separating the rollers thereof prior to actual use, during shipping or during storage.

2. Description of the Related Art

Generally, in electrophotographic devices such as laser printers, a rubber coated developer roll is designed to be in contact with an aluminum photoconductor drum or PC drum. During operation of the electrophotographic device, it is expected that these two rotating members remain in constant contact with each other and that there is a nominal compression of the developer roll by the PC drum. However, prior to actual use or during shipping or storage, it is desirable to separate the rollers and PC drums. For example, some rollers and PC drums will chemically degrade other rollers and PC drums when maintained in stationary contact for long periods of time, especially at higher temperature and humidity conditions. This chemical degrading may result in defects in a printed page. In other cases, where one roll is softer than another roll and the softer roll may develop flat spots over time when maintained in stationary contact with the harder roll. The time period involved for such damage to occur varies with the chemistry and environment but may sometimes be on the order of six to eight weeks. Frequently, the shipping and shelf life of a product prior to use by the end customer exceeds this period. Moreover, the uncontrolled temperatures during shipment may accelerate the chemical reaction.

Some manufacturers solve this problem by installing a separator sheet between a roll and the PC drum. Others use a throwaway wedge that lifts the roll off the PC drum. Electrophotographic products are generally shipped with various rollers separated from each other using such approaches. During the unpacking and set up of the product, the customer is instructed to remove these separating devices and dispose of or recycle them. The product will not function correctly if these devices are not removed.

In addition to separator sheets or wedges, some manufacturers have used cam devices. These cam devices are designed to provide an interference fit between the cam and a roll shaft. However, such an interference fit can generate noise during normal printing operations and this further reduces the reliability of the cam. Further, any radial interference between the cam and the roll shaft can create a frictional drag such that the roll stalls or slips against the PC drum which can cause print defects.

Thus, there is a need to provide a mechanism that addresses at least some of the above problems and provide a reliable separation between the various rolls of an electrophotographic printer such as the developer roll and the PC drum without imposing unneeded frictional forces.

SUMMARY

Example embodiments overcome shortcomings of prior separator devices and thereby satisfy a significant need for a mechanism for effectively separating normally-contacting rolls which releases such separation without user interaction.

According to an example embodiment, an apparatus includes a first component mounted within the apparatus and having a shaft, a second component rotatably mounted within the apparatus in proximity with the first component, wherein the first component is translatable relative to the second component and the first component and second component are each rotatable in a first direction and a second direction, and a separator device for separating the second component and the first component. The separator device comprises a clutch mountable about an end portion of the shaft, the clutch rotating with the shaft when the shaft rotates in a first direction and rotating about the shaft when the shaft rotates in a second direction; and a separator member having a first segment having an aperture sized for mounting the separator member on to the clutch so that the separator member and clutch rotate together; and a second segment extending from the first segment and having an outer contact surface for contacting the second component and spacing a portion of the first component from the second component when the separator device is in a first rotational position and when the second component rotates in the first direction the separator member and the clutch rotate in the second direction about the shaft of the first component allowing the separator member to disengage and move to a second rotational position about the shaft allowing an outer surface of the second component and an outer surface of the portion of the first component to contact each other and when the first component rotates in the first direction the clutch engages the shaft of the first component rotating the separator device in the first direction back to the first rotational position and into contact with the second component thereby spacing a portion of the first component from the second component.

In a further embodiment the outer contact surface comprises a first portion dimensioned to prevent surface contact between the first and the second components when the separator device is in the first rotational position; and a second portion adjacent the first portion and dimensioned to facilitate disengagement of the second component from the separator device when the separator device is rotated away from the first rotational position towards the second rotational position allowing the first and second components to contact each other when the separator device is in the second rotational position.

BRIEF DESCRIPTION OF THE DRAWINGS

A more thorough understanding of the example embodiments may be had from the consideration of the following detailed description taken in conjunction with the accompanying drawings.

FIGS. 5A and 5B are end views of a roll assembly of FIG. 2 when in a first, initial position.

FIGS. 6A and 6B are end views of the roll assembly of FIG. 2 when in a second position.

DETAILED DESCRIPTION

Figure 1:
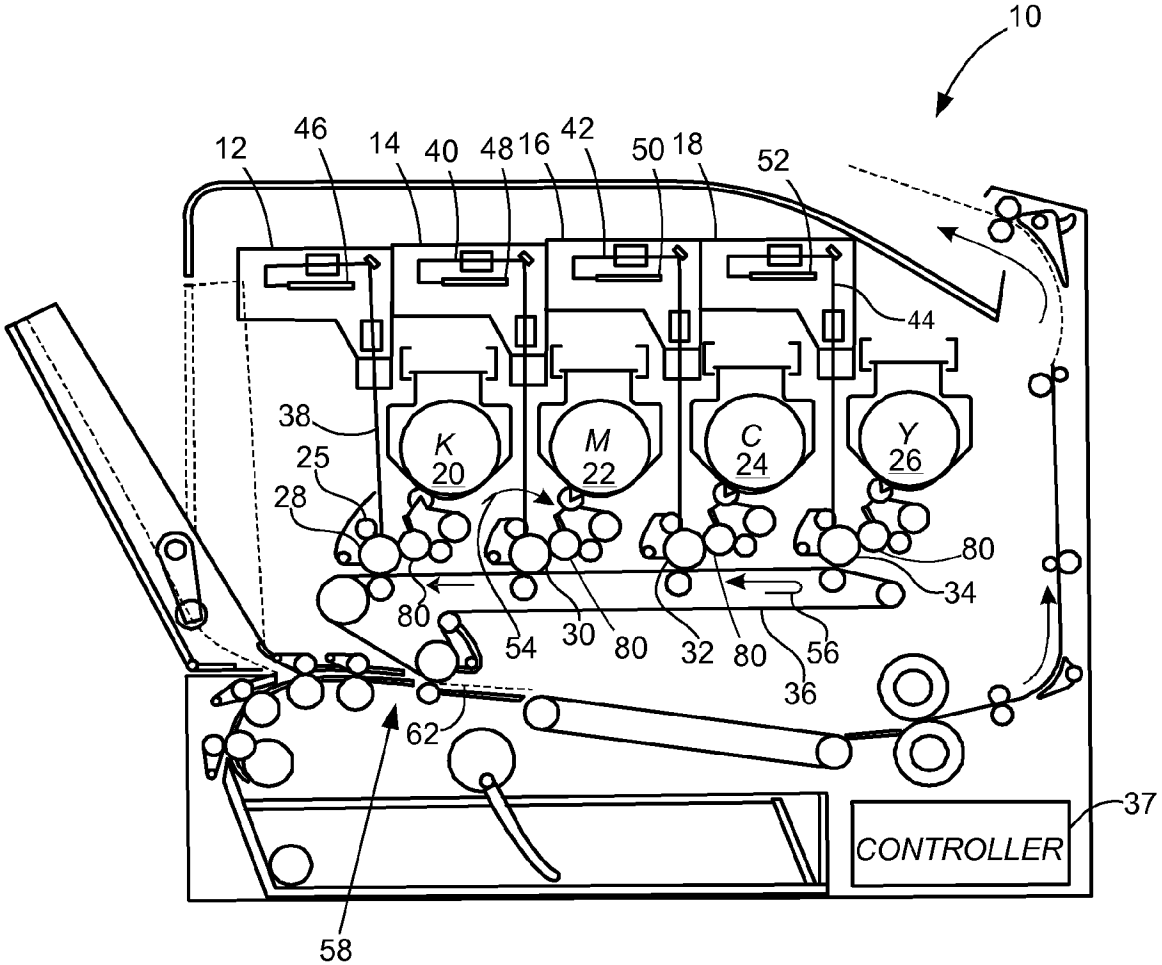
FIG. 1 is a cross-sectional depiction of one embodiment of an electrophotographic printer.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now to the drawings and more particularly to FIG. 1, there is shown one embodiment of an electrophotographic printing device 10 in which embodiments of the present disclosure may be applied. Of course the present disclosure is in no way limited to any specific printer design and may be applicable to a variety of different arrangements.

The printing device 10 includes laser print heads 12, 14, 16, and 18, a black toner cartridge 20, a magenta toner cartridge 22, a cyan toner cartridge 24, a yellow toner cartridge 26, photoconductor drums or PC drums 28, 30, 32, and 34, an intermediate transfer belt 36, and a controller 37. In one embodiment, the controller may be a combination of application specific integrated circuits, microprocessors, and firmware suited to the tasks of printing documents.

Each of the laser print heads 12, 14, 16, and 18 projects a respective laser beam 38, 40, 42, and 44 off a respective one of the polygonal mirrors 46, 48, 50, and 52. As each of the polygonal mirrors 46, 48, 50, and 52 rotates, it scans a respective one of the reflected beams 38, 40, 42, and 44 in a scan direction, perpendicular to the plane of FIG. 1, across a respective one of the PC drums 28, 30, 32, and 34.

Each of the PC drums 28, 30, 32, and 34 may be negatively charged, for example, to approximately −1000 volts, and is subsequently discharged to a lower level, such as approximately −300 volts, in the areas of the peripheral surface that are impinged by a respective one of the laser beams 38, 40, 42, and 44.

During each scan of a laser beam across the PC drum, each PC drum 28, 30, 32, and 34 is continuously rotated, for example, in a clockwise direction, in a process direction indicated by the arrow 54. The scanning of the laser beams 38, 40, 42, and 44 across the peripheral surface of the PC drums 28, 30, 32, and 34 is cyclically repeated, thereby discharging the areas of the peripheral surfaces on which the laser beams 38, 40, 42, and 44 impinge.

The toner in each of the toner cartridges 20, 22, 24, and 26 is negatively charged and is transported upon the surface of a developer roll 80 and biased, for example, to approximately −600 volts. Thus, when the toner for the cartridges 20, 22, 24, and 26 is brought into contact with the respective one of the PC drums 28, 30, 32, and 34, the toner is attracted to and adheres to the portions of the peripheral surfaces of the PC drums 28, 30, 32, and 34 that have been discharged to the lower voltage, say −300 volts, by the laser beams.

As the belt 36 rotates in the direction indicated by the arrow 56, the toner from each of the PC drums 28, 30, 32, and 34 is transferred to the outside surface of the belt 36. As a print medium, such as paper, travels along the path 58, the toner is transferred to the surface of the print medium and nip 62.

For illustrative purposes only, the term "first roll" is used to refer to the developer roll 80 and the term "second roll" is used to refer to a PC drum 28, 30, 32, 34. Of course, this should not be considered limiting since the invention is capable of other embodiments involving other types of rolls.

Figure 2:
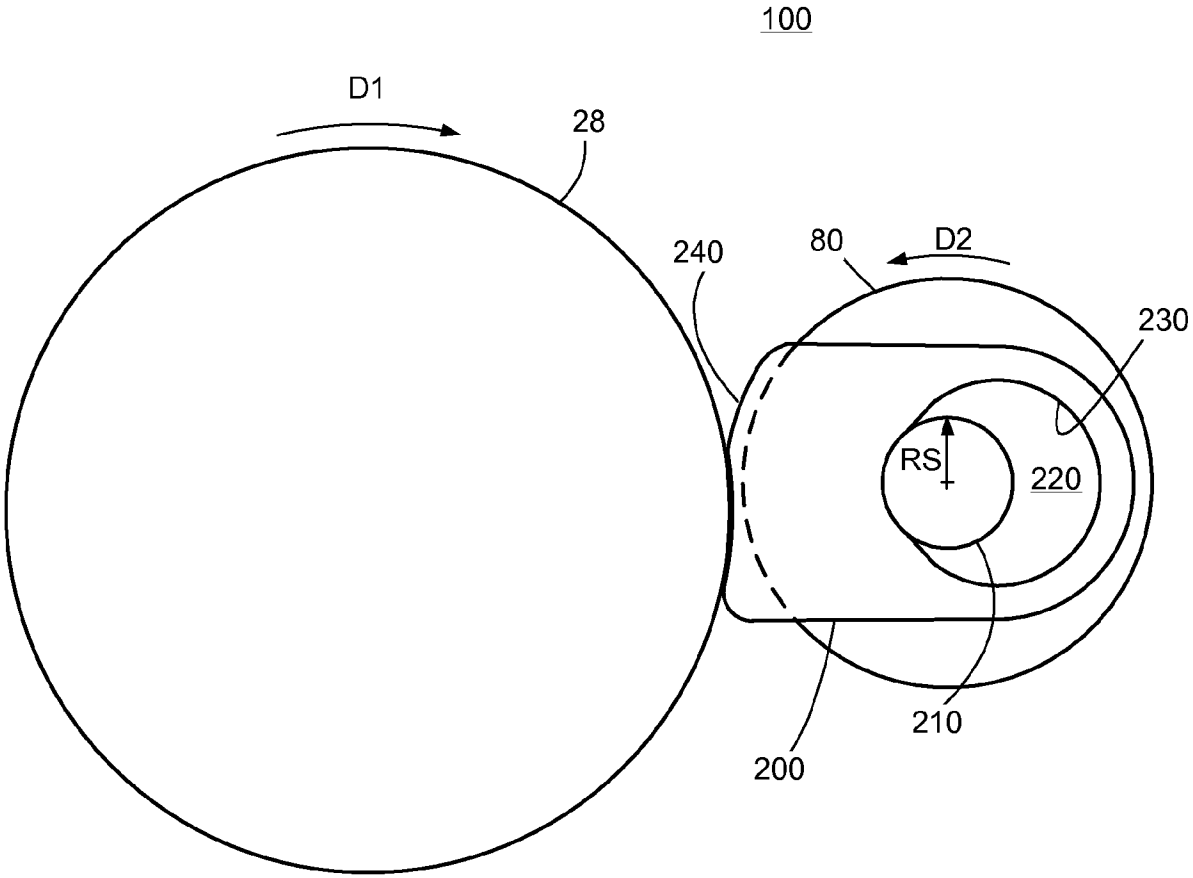
FIG. 2 is a side view of a portion of a roll assembly of the printer of FIG. 1 according to an example embodiment.

FIG. 2 shows a roll assembly 100 including a first roll 80, a second roll 28 and a separator device 200. The first roll 80 may include a shaft 210 about which the first roll 80 rotates. The first roll 80 and the second roll 28 may be rotatably mounted and disposed relative to each other so that the outer surfaces of the rolls normally contact each other. In normal operation, second roll 28 is driven in a direction D1 while first roll 80 is driven in the direction D2 at a speed that is higher than that of second roll 28. In other embodiments one roll may be a driven roll and the other roll undriven and rotation of the driven roll causes rotation of the other. In addition, at least one of the first roll 80 and the second roll 28 may be translatable relative to each other so that the first roll 80 and the second roll 28 may be separated at least temporarily.

A separator device 200 may be disposed at each end of the shaft 210 of the first roll 80. In general terms, the separator devices 200 contact the second roll 28 so as to separate the first roll 80 and the second roll 28 when the separator devices 200 are in a first or initial position as shown in FIG. 2. This first position of the separator devices 200 may be, for example, the position when the printing device 10 is shipped from the manufacturer or when it is placed in storage after use. Upon initial rotation of the first roll 80 and the second roll 28, the separator devices 200 rotate with the first roll 80 in the direction D2 until reaching a second position at which the separator devices 200 no longer rotate. During rotation between the above-mentioned first and second positions, the separator devices 200 lose contact with the second roll 28 so that in the second position the outer surfaces of the first roll 80 and the second roll 28 contact each other. When the separator devices 200 are in this second position, the first roll 80 and the second roll 28 are in their normal operational positions within printer 10.

Each separator device 200 may include an aperture 220 defined through separator device 200 for mounting on the shaft 210 of the first roll 80. The aperture 220 has an inner bearing surface 230 for engaging with the shaft 210. The inner bearing surface 230 of the aperture 220 may be defined by a plurality of circular arcs of differing radii so that the separator devices 200 engage with the shaft 210 differently depending upon the angular position of the separator devices 200 about the shaft 210, as will be discussed in greater detail below. Each separator device 200 further includes an outer contact surface 240 which contacts the second roll 28 when the separator devices 200 are in the first position, separating the first roll 80 from the second roll 28.

Figure 3:
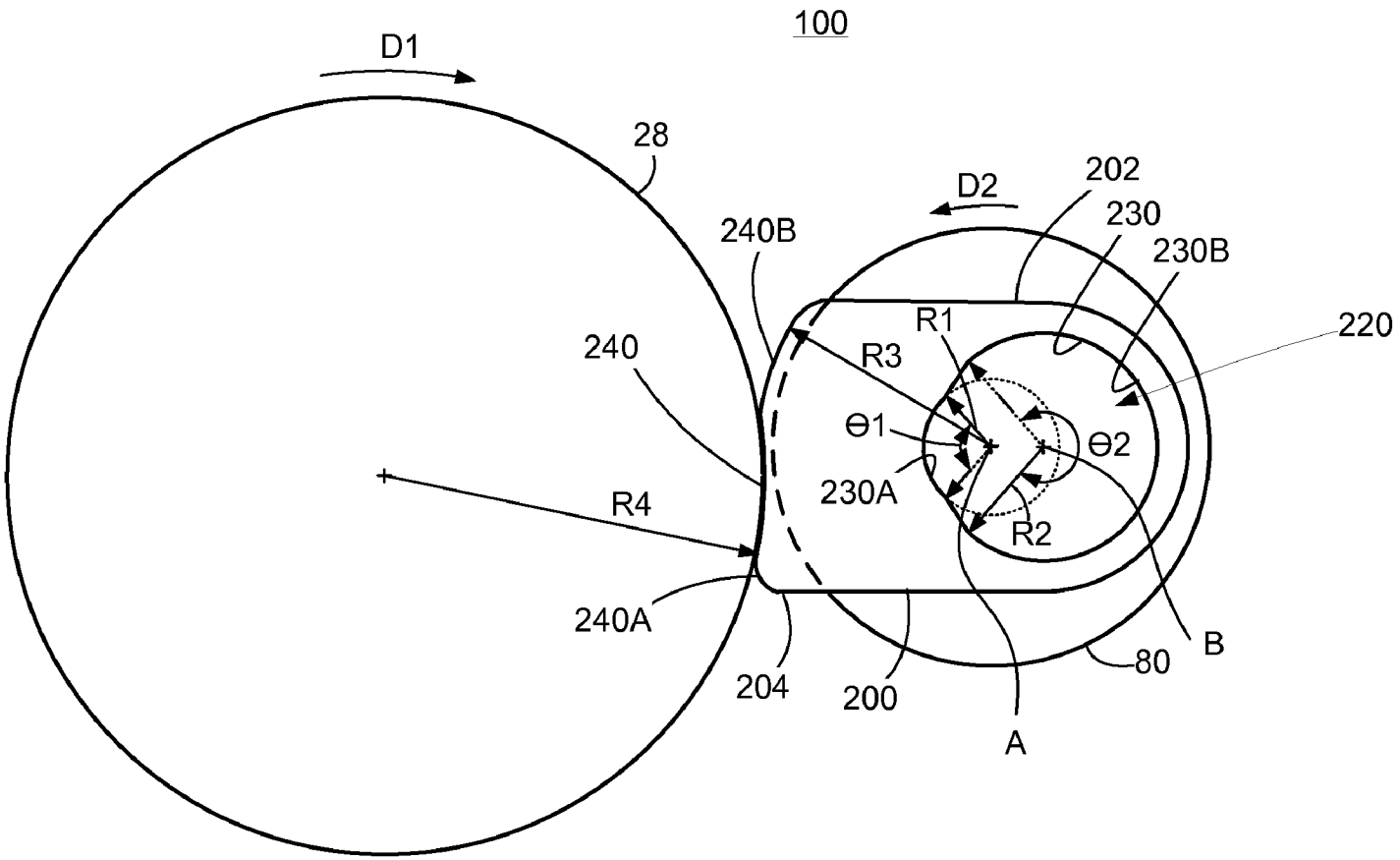
FIG. 3 depicts a side detailed view of the roll assembly of FIG. 2.

A detailed view of the various features of the separator device 200 in relation to the first roll 80 and the second roll 28 is shown in FIG. 3. Separation device 200 may include a first segment 202 having aperture 220 and a second segment 204 having outer contact surface 240. Inner bearing surface 230 of the aperture 220 of the separator device 200 may include a first portion 230A and a second portion 230B. The first portion 230A is defined by a first arc dimensioned to engage with the shaft 210 when the separator device 200 is in the first position so as to initially engage and rotate with the shaft 210 when the shaft 210 rotates. The first arc defining the first portion 230A is defined by a first angle θ1 and a first radius R1 originating along a first axis A. In this embodiment, the first radius R1 is substantially equal to the radius RS (FIG. 2) of the shaft 210 in order to ensure engagement of separator device 200 with the shaft 210. The second portion 230B of inner bearing surface 230 is defined by a second arc dimensioned so that the separator device 200 relatively loosely rests on the shaft 210 when the device 200 is in the above-mentioned second position. The second arc defining the second portion 230B is defined by a second angle θ2 and a second radius R2 originating along a second axis B. The second radius R2 is greater than the first radius R1. As a result, with the separator device 200 loosely resting on the shaft 210 when in the second position, the separator device 200 will not further rotate despite continued rotation of the first roll 80 and the second roll 28.

In the above example embodiment, the second axis B is positioned apart from the first axis A. It is understood that in other embodiments, the second axis B may be coincident with the first axis A (see FIG. 8A).

The second segment 204 of the separator device 200 extends from the first segment 202 and includes outer contact surface 240 for contacting the outer surface of the second roll 28. The outer contact surface 240 may include a first portion 240A and a second portion 240B. The first portion 240A is concave and is defined by an arc having a radius R4 which is substantially equal to the radius of the second roll 28. The arc defining the first portion 240A is dimensioned to relatively securely engage with the second roll 28 when the separator devices 200 are in the first position and in doing so prevent surface contact between the first roll 80 and the second roll 28, as shown in FIGS. 2 and 3. First portion 240 A also prevents separator device 200 from being rotated past the first position when it is installed to separate first and second rolls 80, 28.

The second portion 240B of the outer contact surface 240 may be convex and defined by an arc having a radius R3 originating along a pivot axis of the separator device 200. The arc defining the second portion 240B, which is adjacent the first portion 240A, is dimensioned to facilitate disengagement of the second roll 28 from the separator device 200 when the separator device 200 is rotated away from the first position towards its second, final position. This disengagement will allow surface-to-surface contact between the first roll 80 and second roll 28. In the present embodiment, the first axis A is the pivot axis of the nip separator device 200 when the device 200 is rotated from the first position towards the second position and it is also the axis of rotation of the shaft 210.

Separator device 200 may be molded from a thermoplastic elastomer such as one that sold by Advanced Elastomer Systems under the trademark SANTOPRENE or other similar elastomers may be used. In one form, the elastomer used for separator device 200 may be characterized as having resistance to compression set as compression set would diminish the separation between the two components and a coefficient of friction sufficient to allow separator device 200 to get traction on the moving component. Also, use of such an elastomer eliminates or reduces flash or sharp edges that could damage the PC drum surface when a PC drum is one of the components to be separated.

Figure 4A:
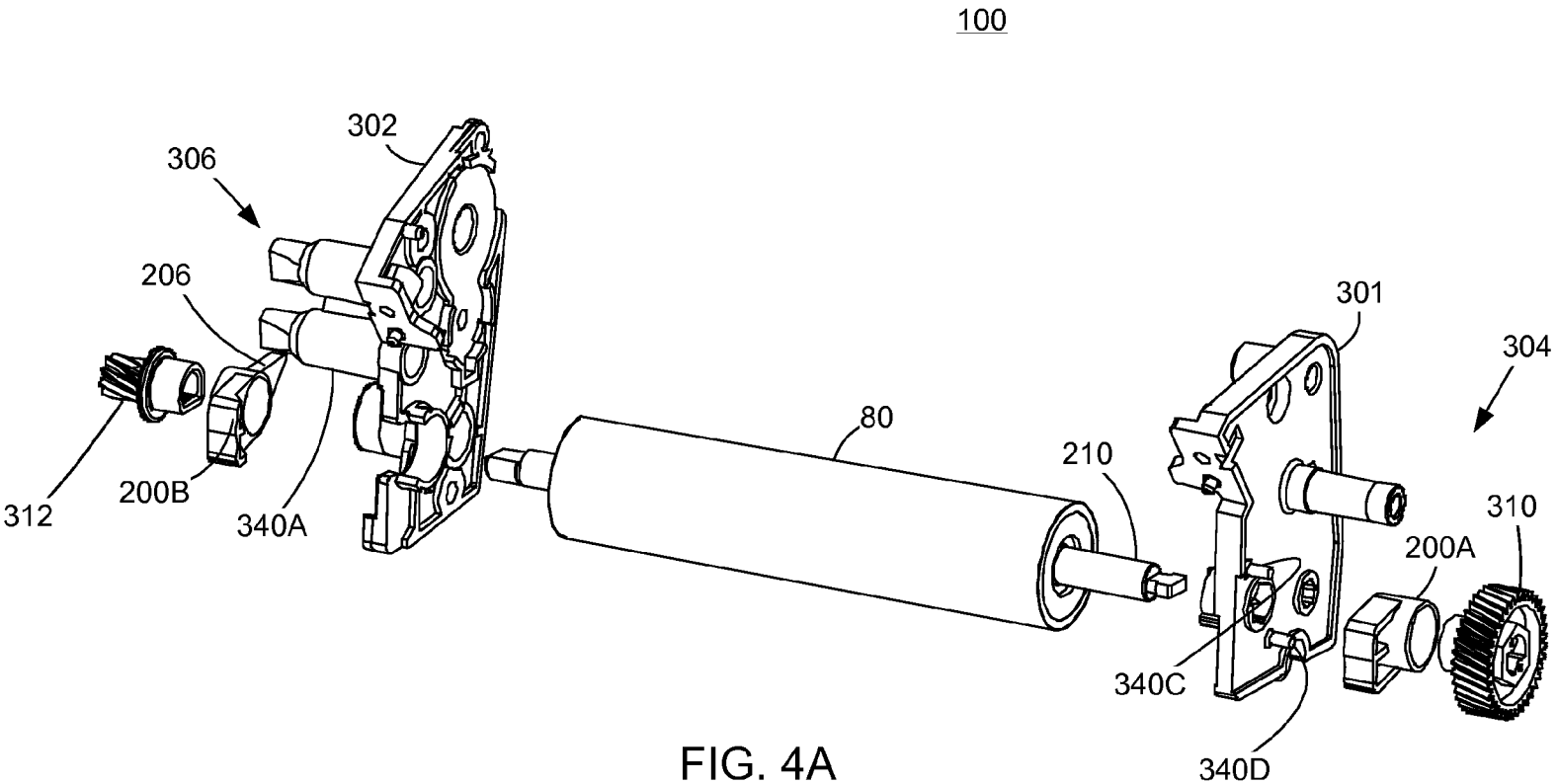
FIG. 4A provides an exploded perspective view of at least a portion of a roll assembly according to an example embodiment.
Figure 4B:
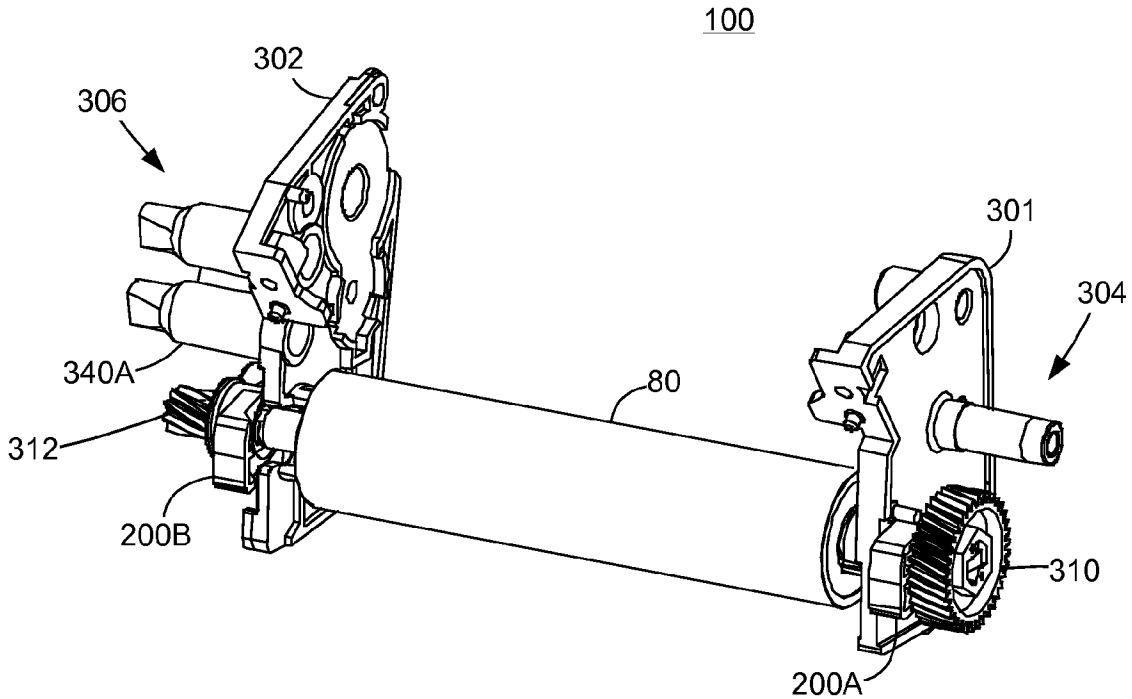
FIG. 4B shows a perspective view of the roll assembly of FIG. 4A.

FIG. 4A provides an exploded view showing the arrangement some of the components of roll assembly 100, including a frame having frame portions 301 and 302 from which first roll 80 and second roll 28 (not shown in FIG. 4A) are rotatably mounted. Drive gear 310 may be disposed along frame portion 301 and attaches to shaft 210 for driving first roll 80, additional gearing not shown is used to drive second roll 28. A driven gear 312 is shown attached to the other end of shaft 210. To enable spacing between the first roll 80 and the second roll 28, a separator device 200A is mounted on the driven side 304 and another separator device 200B is mounted on the non-driven side 306 of roll assembly 100. FIG. 4B shows the assembled roll assembly 100.

As shown in FIGS. 4A and 4B, frame 301 may include upper and lower stop posts 340C, 340D while frame portion 302 may include upper and lower stop posts 340A, 340B, each of which extend generally outwardly from a side thereof. Further, the separator device 200B mounted on the non-drive side 306 of the roll assembly 100 may include a third segment 206. FIGS. 5B and 6B provide a clearer view of the separator device 200B with the third segment 206. The third segment 206 extends from the first segment 202 and is dimensioned to contact lower stop post 340B to ensure that separator device 200B does not rotate beyond its first, initial position and to contact upper top post 340A to ensure that the separator device 200B is prevented from rotating further when the device 200B is in its second, final position. On frame portion 301, upper and lower stop posts 340C, 340D extend outwardly from the side thereof and are positioned to contact the second segment 204 of separator 200A (see FIG. 6A) so a third segment 206 would not be needed. Upper stop post 340C ensures that separator device 200A does not rotate beyond its first, initial position while lower stop post 340D ensures that separator device 200A does not rotate beyond its second position. The number and positioning of stop posts on frame portions 301, 302 and use of a third segment on none, one or both separator devices is a matter of design choice.

The operation of the roll assembly 100 will now be described in connection with FIGS. 5A-5B and 6A-6B. FIGS. 5A and 5B are end views of the roll assembly 100 when the separator devices 200 are in their respective first or initial positions. Each separator device 200A, 200B is positioned so that the first portion 240A of outer contact surface 240 contacts the second roll 28. Each separator device 200A, 200B is dimensioned such that the first roll 80 and the second roll 28 are spaced apart from each other when the separator devices 200A, 200B are in the first position. Further, the engagement between the separator devices 200A, 200B and the second roll 28 results in a force being applied to the separator devices 200A, 200B to cause the first portion 230A of inner bearing surface 230 to contact the shaft 210 of the first roll 80 and frictionally engage therewith. As a result, initial rotation of the first roll 80 in the direction D2 and initial rotation of second roll 28 in direction D1, as shown on FIGS. 5A and 5B, causes the separator devices 200A, 200B to rotate therewith.

Both separator devices 200A, 200B actually rotate in the same direction when viewed from one end or the other end of roll assembly 100. However the views illustrated in FIGS. 5A, 5B, seem to make separator device 200A appear to rotate counterclockwise in FIG. 5A and the separator device 200B appears to rotate clockwise in FIG. 5B, which is not the case.

As the separator devices 200A and 200B continue to rotate with the first roll 80, contact with the second roll 28 transitions from first portion 240A of outer contact surface 240 to second portion 240B thereof. The separator devices 200 continue to rotate until contact with the second roll 28 ends allowing the separator devices 200 to drop into the second, final position as shown in FIGS. 6A and 6B. In this position, the separator devices 200A and 200B loosely rest on the shaft 210 with the second portion 230B of the inner bearing surface 230 contacting the shaft 210. With the larger dimension of the second portion 230B in relation to the shaft 210, the possibility of the separator device 200 rotating further with the shaft 210 is remote. Nevertheless, the stop post 340 further ensures that the separator device 200B, when disengaged and in the second position, cannot rotate further with the shaft 210. When the separator devices 200A and 200B are in the second position, surface contact between the first roll 80 and the second roll 28 is established (see FIGS. 6A and 6B).

Figure 7A:
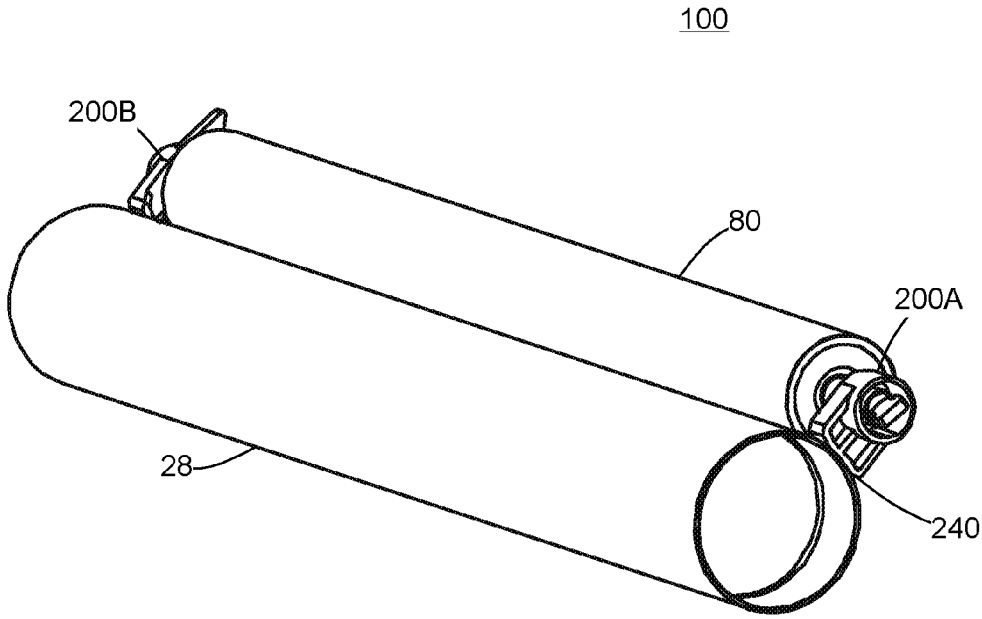
FIGS. 7A and 7B are perspective views of the roll assembly of FIGS. 5A and 6A, respectively.
Figure 7B:
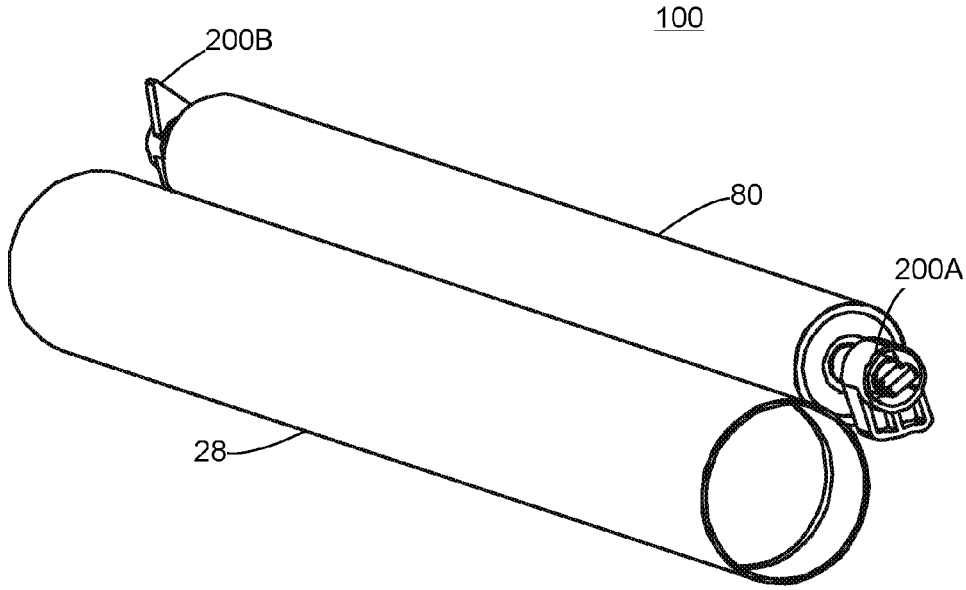

FIG. 7A shows a perspective view of roll assembly 100 with the separator devices 200A and 200B in the first, initial position and the outer contact surface 240 contacting the outer surface of second roll 28 to prevent surface contact between the first roll 80 and the second roll 28. FIG. 7B is another perspective view of roll assembly 100 with separator devices 200A and 200B in the second, final position disengaged from the second roll 28. Once disengaged, the separator devices 200A and 200B loosely rest on the shaft 210, allowing the outer surface of the first roll 80 to contact the outer surface of second roll 28.

Figure 8A:
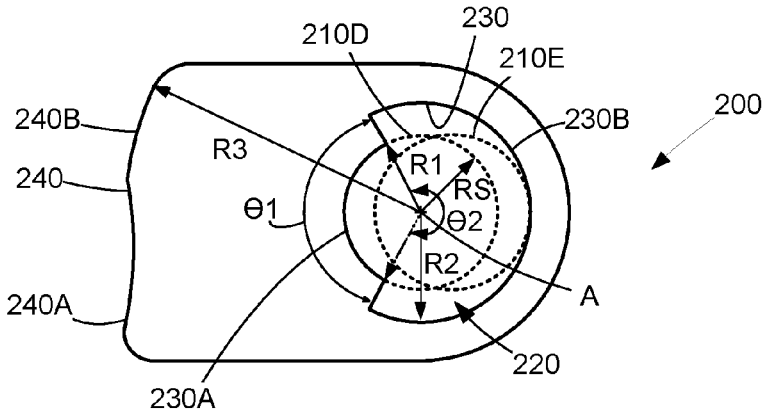
FIGS. 8A-8C are views of the separator device according to alternative embodiments.
Figure 8B:
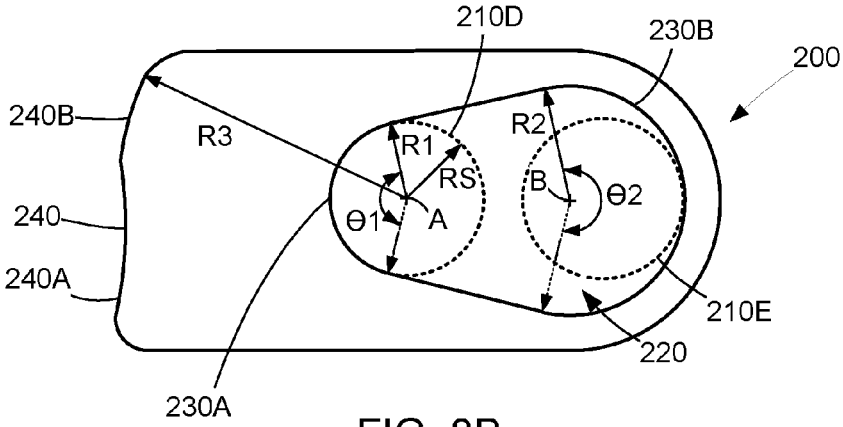
Figure 8C:
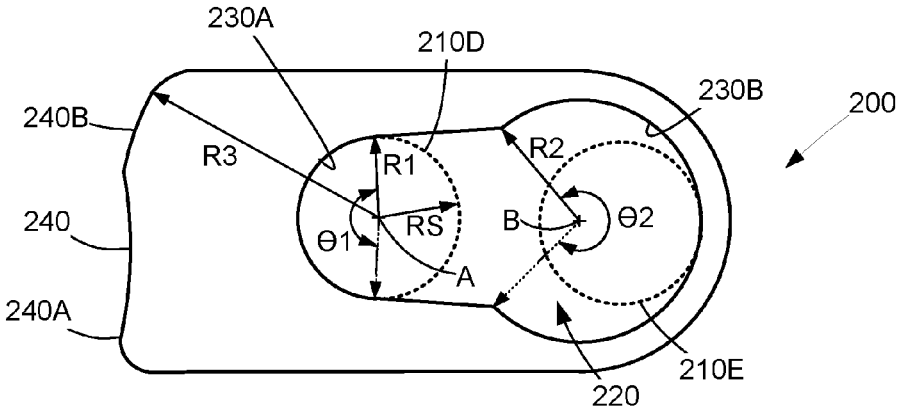

FIGS. 8A, 8B and 8C show additional embodiments of the separator device 200. FIG. 8A shows the first portion 230A and the second portion 230B of the inner bearing surface 230 having radii R1 and R2, respectively. In this embodiment, radii R1 and R2 may originate along the same axis, first axis A. The radius R3 of the arc defining the second portion 240B of the outer contact surface 240 also originates along the first axis A since in this embodiment, the first axis A is also the pivot axis of the separator device 200 when the device is rotated from the first position towards the second position. FIG. 8A also shows the location 210D of the shaft 210 when the separator device 200 is in the first position and the location 210E of the shaft 210 when the device 200 is in the second position.

The separator device 200 in FIGS. 8B and 8C depict additional embodiments of the separator devices 200 having differently shaped apertures 220. In these embodiments, the first axis A (denoting the origin of radius R1 of first portion 230A) and the second axis B (denoting the origin of radius R2 of second portion 230B) are separated by a distance longer than either radius R1 or R2. In this embodiment, the radius R3 (corresponding to the curve of second portion 240B of outer contact surface 240) originates along the first axis A. FIGS. 8B and 8C also show the location 210D of the shaft 210 when the separator device 200 is in the first position and the location 210E of the shaft 210 when the separator device 200 is in the second position. Aperture 220 in FIG. 8C may be said to have a keyhole shape.

Figure 9A:
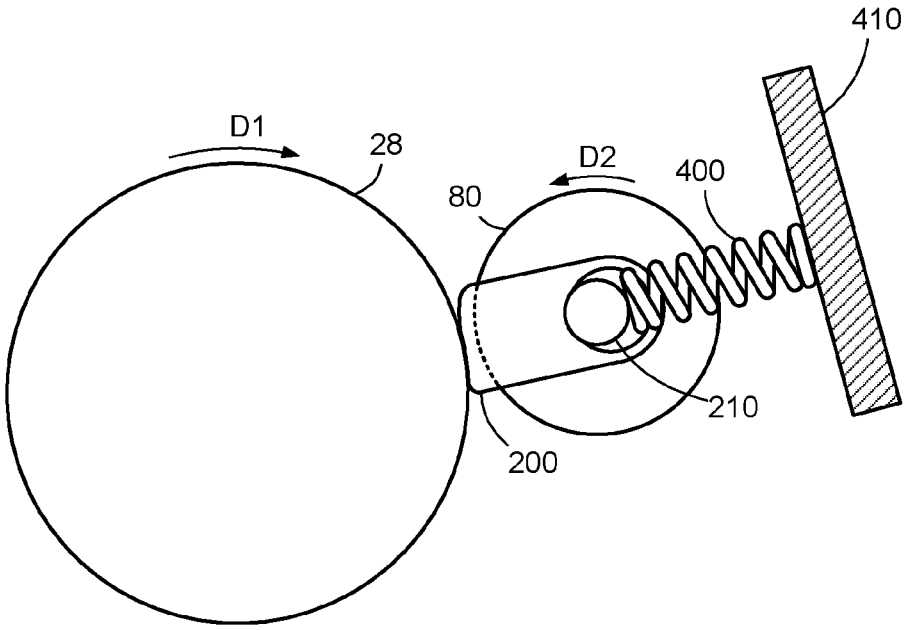
FIGS. 9A and 9B are side views illustrating a biasing mechanism of the roll assembly of FIG. 2.
Figure 9B:
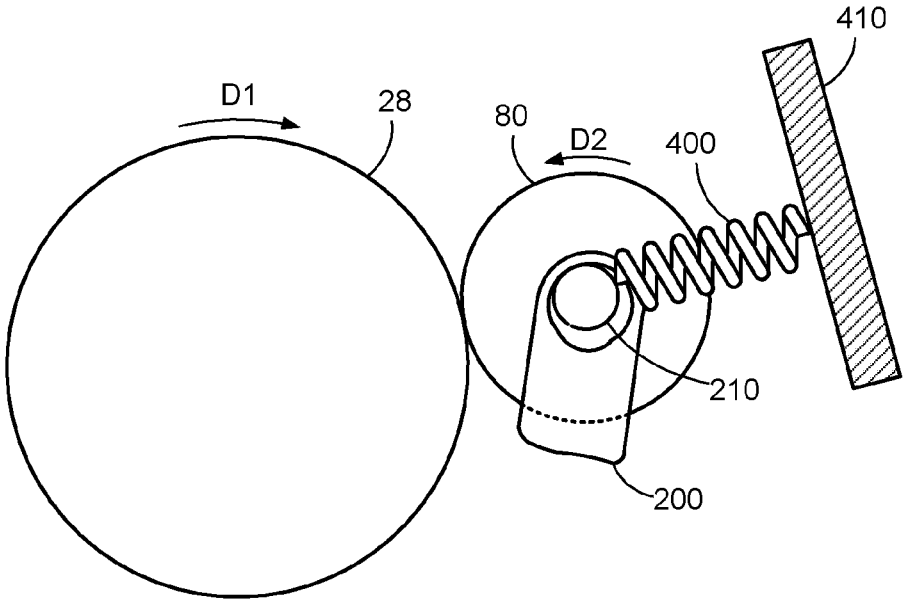

As mentioned above, one of the first roll 80 and the second roll 28 is translatable relative to the other so as to allow for the two rolls to be spaced apart by the separator devices 200. Accordingly, the roll assembly 100 may further include a biasing mechanism for urging together the first roll 80 and the second roll 28. FIGS. 9A and 9B show an example embodiment in which a compressible spring 400 is disposed between the shaft 210 and a portion of a frame 410 of the roll assembly 100. The spring 400 acts to urge the shaft 210 of the first roll 80 towards the second roll 28. When the separator devices 200 are in the first position as shown in FIG. 9A, the first roll 80 is spaced from the second roll 28 and the spring 400 is compressed. When the separator devices 200 are in the second position, as shown in FIG. 9B, the spring 400 urges the first roll 80 into contact with the second roll 28 so as to provide surface-to-surface contact therewith. In embodiments where only one of the first and second rolls are driven, the rotation of the driven roll would cause the other roll to rotate.

It is understood that the present invention applies to other possible embodiments wherein the second roll 28 is spring-loaded or both the first roll 80 and the second roll 28 are spring-loaded.

Figure 10:
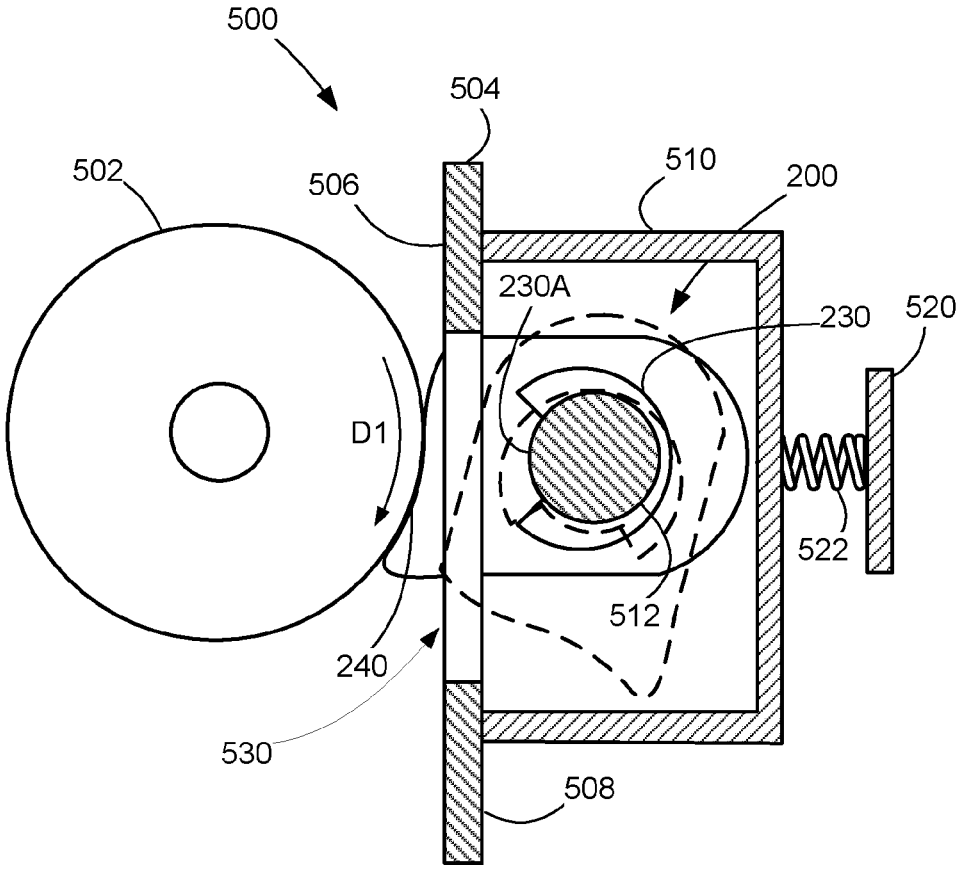
FIG. 10 is a partial sectional side view of a roll assembly according to another example embodiment.

FIG. 10 depicts a roll-plate assembly 500 employing the separator devices 200 to provide separator between a roll 502 and a planar surface other than a roll surface, such as a plate 504 having first and second surfaces 506, 508. Plate 504 may be flat or curved. Roll 502 is mounted proximate first surface 506 with one of roll 502 and plate 504 being translatable with respect to the other. At least one separator device 200 is mounted on each of a pair of pivot mounts 510 which all for the rotatable mounting of each separator device 200 such as by use of a fixed pivot 512. Mounts 510 may be mounted on second surface 508 or on a frame 520. A spring 522 may be disposed between frame 520 and the plate 504 or as shown between frame 520 and mount 510. When the separator devices are in the first position, the first portion 230A of the inner bearing surface 230 of each separator device 200 engages with the pivot 512 and the outer contact surface 240 contacts and frictionally engages with the outer surface of roll 502. When the separator devices 200 are in the first position, the separator devices 200 extend through a pair of spaced apart apertures 530 located proximate to each mount 510 in the plate 504 and contact between the separator devices 200 and the roll 502 separates plate 504 and roll 502. The apertures 530 are sized to allow separator devices 200 to rotate below first surface 506 so as not to interfere with material being fed between roll 502 and plate 504 as illustrated by the dashed line image for separator device 200. When the roll 502 rotates in the direction D1, the separator devices 200 are rotated to the second position in which the separator devices 200 no longer engage with the roll 502 and rests on top of the pivot 512. Upon disengagement of the separator device 200 from the roll 502, the spring 522 urges surface 506 of the plate 504 against the roll 502 so that surface-to-surface contact between the roll 502 and the plate 504 is established. Conversely roll 502 may be biased against separators 200.

Figure 11:
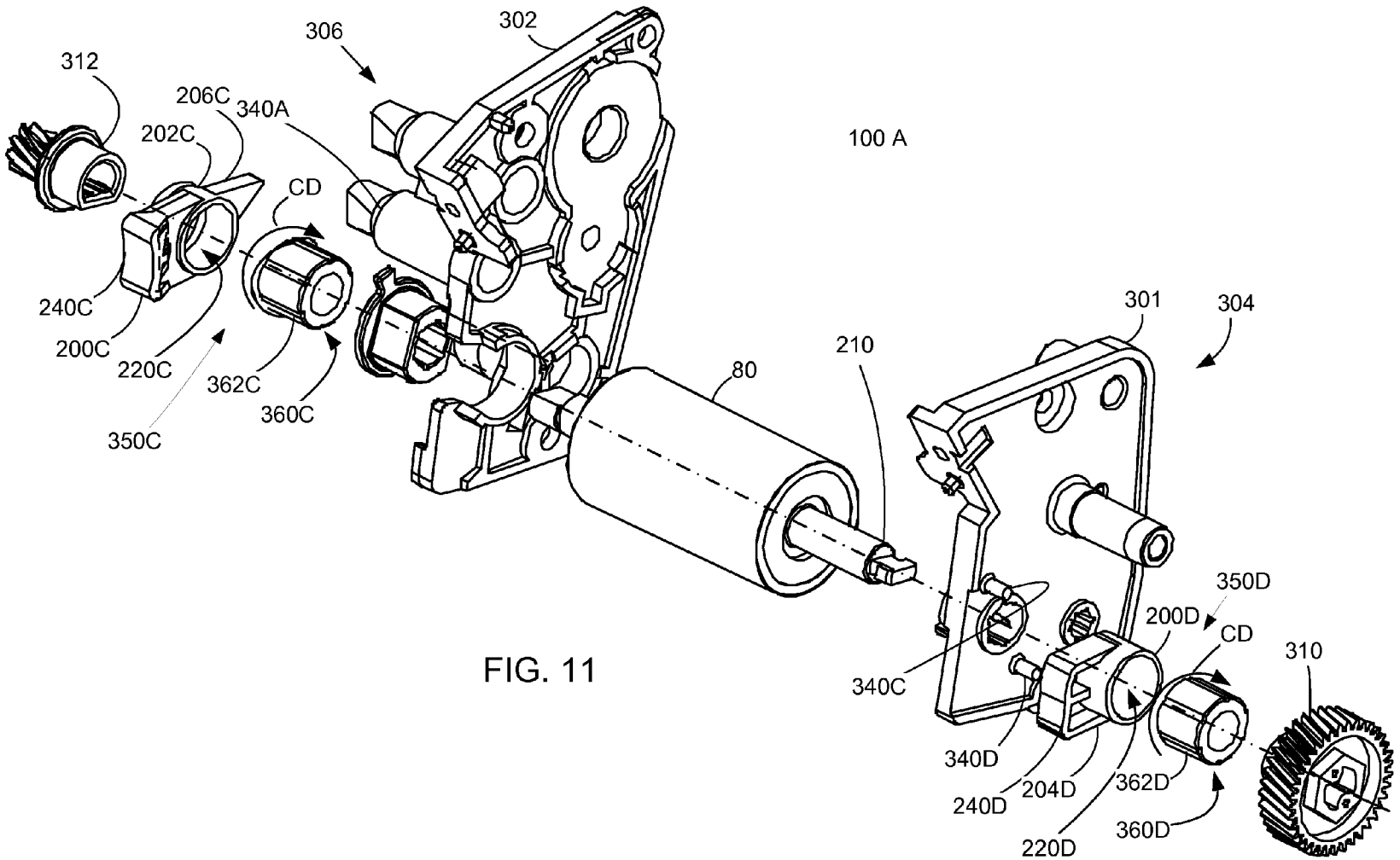
FIG. 11 is another form of the present disclosure illustrating a clutched nip separator assembly.

FIG. 11 illustrates an exploded view showing another form of the roll assembly designated 100A. As illustrated the separator devices 350C, 350D comprise a separator member 200C, 200D and a clutch 360C, 360D. Similar to roll assembly 100, roll assembly 100A has a frame having frame portions 301, 302 from which first roll 80 and second roll 28 (not shown in FIG. 11) are rotatably mounted. Drive gear 310 may be disposed along frame portion 301 and attaches to one end of shaft 210 for driving first roll 80 via a key on the end of shaft 210 and a corresponding keyed opening in drive gear 310. Additional gearing not shown is used to drive second roll 28. A driven gear 312 is shown attached to the other end of shaft 210. To enable spacing between the first roll 80 and the second roll 28, a separator device 350 D is mounted on the driven side 304 and another separator device 350C is mounted on the non-driven side 306 of roll assembly 100. The outer surfaces 240C, 240D of separator members 200C, 200D that contact second roll 28 are shaped the same as that previously described for separators devices 200, 200A, 200B and function in the same manner. Each separator device further includes a clutch, for example, clutches 360C, 360D, on which each separator members 200C, 200D, respectively, are mounted. Clutches 360C, 360D in turn are mounted on shaft 210 of first roll 80. Clutches 360C, 360D rotate with shaft 210 when it rotates in one direction and freely rotate about shaft 210 when it rotates in a second direction. The apertures 220C, 220D in respective separator members 200C, 200D are sized to closely fit around the outer housing of clutches 360C, 360D respectively. Apertures 220C, 220D are not formed by plurality of arcuate surfaces as are found in separator devices 200, 200A and 200B. Ribs may be provided in central apertures 220C, 220D or on the clutch housings to assist in mounting of separator devices 200C, 200D on their respective housings of clutches 360C, 360D and to enhance the frictional force binding separator member 200C, 200D to their respective clutches 360C, 360D. As illustrated ribs 362C, 362D are shown on clutches 360C, 360D. A clutched direction CD (shown by arrows) is one where the clutches 360C, 360D are engaged and rotate with shaft 210 of first roll 80. When shaft 210 rotates opposite to the clutched direction, the clutches 360C, 360D freely rotate about the shaft 210 without moving separator members 200C, 200D. Various types of one-way clutches may be used. Exemplary clutches include but are not limited to a wrapped spring clutch or a ball clutch such as part number 0WC610GXRZ B8 manufactured by Origin Precision Machine (Shanghai) Company, Ltd of Shanghai, China.

When separator members 200C, 200D are in their initial position and engaged with second roll 28, rotation of second roll 28 in a first direction, i.e., the clutched direction CD causes them to rotate opposite to the clutched direction CD toward their respective second rotational positions. When separator members 200C, 200D rotate in a second direction, e.g. opposite to the clutch direction CD, clutches 220C, 220D are not engaged with shaft 210 of first roll 80 and allow separator devices 200C, 200D to freely rotate or fall to their second rotational position once they disengage with second roll 28. Should it be determined that separator devices 350C, 350D need to return to their first rotational positions, first roll 80 is reversed and rotates in the clutched direction CD for a predetermined time period sufficient to allow separator members 200C, 200D to be driven back to their respective first rotational positions. When this occurs, clutches 360C and 360D engage with shaft 210, which in turn, drive separator members 200C, 200D to return to their initial or first rotational positions. Having the separators 200C, 200D capable of being driven back to their first rotational position is useful, for example, when either the imaging apparatus detects that it is idle more than a predetermined time period or if a user desires to put the imaging apparatus in an idle or non-operational condition for a lengthy period. With non-clutched separator devices previously described this function would have to be performed manually.

For roll assembly 100A, frame portion 301 may include upper and lower stop posts 340C, 340D while frame 302 may include upper and lower stop posts 340A, 340B, (only upper stop post 340A is visible in FIG. 11) each of which extend generally outwardly from a side thereof. Further, separator member 200C of separator device 350C mounted on the non-drive side 306 of the roll assembly 100 may include a third segment 206C as previously described. The third segment 206C extends from the first segment 202C and is dimensioned to contact lower stop post 340B (see FIG. 5A, B to see stop posts 340A, 340B) on frame portion 302 to ensure that separator device 350C does not rotate beyond its first, initial position and to contact upper top post 340A to ensure that the separator device 350C is prevented from rotating further when the separator device 350C is in its second, final position. On frame portion 301, upper and lower stop posts 340C, 340D extend outwardly from the side thereof and are positioned to contact the second segment 204D of separator member 200D so a third segment would not be used. Upper stop post 340C ensures that separator device 350D does not rotate beyond its first, initial position while lower stop post 340D ensures that separator device 350D does not rotate beyond its second position. The number and positioning of stop posts on frame portions 301, 302 and use of a third segment on none, one or both separator devices is a matter of design choice.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. In an apparatus including a first component mounted within the apparatus and having a shaft, a second component rotatably mounted within the apparatus in proximity with the first component, wherein the first component is translatable relative to the second component and the first component and second component are each rotatable in a first direction and a second direction, a separator device for separating the second component and the first component, the separator device comprising:

a clutch mountable about an end portion of the shaft, the clutch rotating with the shaft when the shaft rotates in a first direction and rotating about the shaft when the shaft rotates in a second direction; and a separator member having:

a first segment having an aperture sized for mounting the separator member on to the clutch so that the separator member and clutch rotate together; and a second segment extending from the first segment and having an outer contact surface for contacting the second component and spacing a portion of the first component from the second component when the separator device is in a first rotational position, and when the second component rotates in the first direction the separator member and the clutch rotate in the second direction about the shaft of the first component allowing the separator member to disengage and move to a second rotational position about the shaft allowing an outer surface of the second component and an outer surface of the portion of the first component to contact each other, and when the first component rotates in the first direction the clutch engages the shaft of the first component rotating the separator device in the first direction back to the first rotational position and into contact with the second component thereby spacing a portion of the first component from the second component.

2. The separator device of claim 1, wherein the outer contact surface comprises:

a first portion dimensioned to prevent surface contact between the first and the second components when the separator device is in the first rotational position; and a second portion adjacent the first portion and dimensioned to facilitate disengagement of the second component from the separator device when the separator device is rotated away from the first rotational position towards the second rotational position so as to allow the first and second components to contact each other when the separator device is in the second rotational position.

3. The separator device of claim 2, wherein the second component comprises a cylindrically-shaped component and the first portion of the contact surface is concave and is defined by an arc having a radius substantially equal to a radius of the second component.

4. The separator device of claim 2, wherein the second portion of the contact surface is convex and is defined by an arc having a radius originating along a pivot axis of the separator device when the separator device is in the first rotational position.

5. An assembly, comprising:

a frame;

a first component mounted to the frame and having a shaft rotatable in a first and a second direction, the shaft having a first end and a second end;

a second component rotatably mounted to the frame and disposed in proximity with the first component, wherein at least one of the first component and the second component is translatable relative to the other; and at least two separator devices, at least one separator device mounted on each of the first end and second end of the shaft, wherein each of the at least two separator devices comprises:

a clutch mounted about an end portion of the shaft, the clutch rotating with the shaft when the shaft rotates in the first direction and rotating about the shaft when the shaft rotates in the second direction; and a separator member having:

a first segment having an aperture sized for mounting the separator member on to the clutch so that the separator member and clutch rotate together; and a second segment extending from the first segment and having an outer contact surface for contacting the second component and spacing a portion of the first component from the second component when each of the at least two separator devices are in a first rotational position, and when the second component rotates in the first direction each separator member and corresponding clutch rotates in the second direction about the shaft of the first component allowing each separator member to disengage from the second component and move to a second rotational position about the shaft allowing an outer surface of the second component and an outer surface of the portion of the first component to contact each other, and, when the shaft rotates in the first direction the respective clutch of each of the at least two separator devices engages the shaft of the first component moving the at least two separator devices in the first direction back to their respective first rotational positions and into contact with the second component thereby spacing a portion of the first component from the second component.

6. The assembly of claim 5, wherein the frame includes at least two stop posts and the at least two separator devices comprise:

a first separator device mounted on a drive side of the shaft and contacting one of the at least two stop posts to prevent the first separator device from further rotation when the first separator device is in the second rotational position; and a second separator device mounted on a non-drive side of the shaft, the second separator device having a third segment extending from the first segment and dimensioned to contact with the other of the at least two stop posts to prevent the second separator device from further rotation when the second separator device is in the second rotational position.

7. The assembly of claim 5, wherein the outer contact surface comprises:

a first portion dimensioned to prevent the second component from contacting the first component when the at least two separator devices are in their respective first rotational positions; and a second portion adjacent to the first portion and dimensioned to facilitate disengagement of the second component from each of the at least two separator devices when the second component is rotated in the first direction and the at least two separator devices are rotated away from their respective first rotational positions towards their respective second rotational positions so as to allow the first and second components to contact each other when the at least two separator devices are in their respective second rotational positions.

8. The assembly of claim 7, wherein the second component comprises a cylindrically-shaped component and the first portion of the contact surface has a concave shape defined by a radius that is substantially equal to a radius of the second component.

9. The assembly of claim 7, wherein the second portion of the contact surface is convex and engages with the second component when the plurality of separator devices are positioned between the first rotational position and the second rotational position.

10. An assembly, comprising:

a plate having a first and second surface and a pair of spaced apart apertures therethrough;

a pair of rotatable pivot mounts positioned proximate the second surface and the pair of spaced apart apertures;

a first component rotatably mounted and disposed in proximity to the first surface of the plate wherein at least one of the first component and the plate is translatable relative to the other; and at least two separator devices, at least one separator device rotatably mounted on each one of the pair of pivot mounts, wherein each of the separator devices comprises:

a clutch mounted about its respective rotatable pivot mount, the clutch rotating with the pivot mount when the pivot mount rotates in a first direction and rotating about the pivot mount when the pivot mount rotates in a second direction; and a separator member having:

a first segment having an aperture sized for mounting the separator member on to the clutch so that the separator member and clutch rotate together; and a second segment extending from the first segment and having an outer contact surface extending through its respective aperture in the plate for contacting the first component and spacing the first component from the plate when each of the at least two separator devices is in a first rotational position with respect to the mount, and when the first component rotates in the first direction the separator member moves in the second direction allowing the clutch and separator member to rotate about its respective pivot mount in the second direction with the separator member disengaging with the first component and moving to a second rotational position about its respective pivot mount allowing an outer surface of the first component and a portion of the first surface of the plate to contact each other, and when the pivot mounts rotate in the first direction each clutch engages its respective pivot mount moving the at least two separator devices in the first direction back to the first rotational position and into contact with the first component thereby spacing a portion of the first component from the first surface of the plate.

11. The separator device of claim 10, wherein the outer contact surface comprises:

a first portion dimensioned to prevent surface contact between the first component and the plate when the separator device is in the first rotational position; and a second portion adjacent the first portion and dimensioned to facilitate disengagement of the separator device from the first component when the separator device is rotated away from the first rotational position towards the second rotational position allowing the first component and plate to contact each other when the separator device is in the second rotational position.

12. The separator device of claim 11, wherein the first portion of the contact surface is concave and is defined by an arc having a radius substantially equal to a radius of the first component and the second portion of the contact surface is convex and is defined by an arc having a radius originating along a pivot axis of the separator device when the separator device is in the first rotational position.

* * * * *